United States Patent [19]

Labate

[11] Patent Number: 4,709,748

[45] Date of Patent: Dec. 1, 1987

[54] PROTECTIVE SLEEVE FOR THE SHROUD OF A HOT METAL LADLE

[76] Inventor: Micheal D. Labate, 115 Hazen Ave., Ellwood City, Pa. 16117

[21] Appl. No.: 926,680

[22] Filed: Nov. 4, 1986

[51] Int. Cl.[4] ..... B22D 11/10; B22D 1/00

[52] U.S. Cl. ..... 164/488; 164/437; 164/133; 164/335

[58] Field of Search ..... 164/437, 488, 138, 137, 164/133, 335; 222/590, 591, 594

[56] References Cited

U.S. PATENT DOCUMENTS 4,462,834 7/1984 LaBate ..... 164/123

4,568,007 2/1986 Fishler ..... 164/437

*Primary Examiner*—Nicholas P. Godici
*Assistant Examiner*—Richard K. Seidel
*Attorney, Agent, or Firm*—Harpman & Harpman

[57] ABSTRACT

A sleeve formed of one or more parts of a size to fit closely around the depending shroud of a hot metal ladle through which the hot metal is delivered to a receptacle, such as a tundish, protects the shroud which is a tubular member formed of metal, ceramic or a composition including graphite or silica from the rapid erosion which occurs whenever the shroud is partially immersed in a pool of molten metal in the receptacle.

4 Claims, 5 Drawing Figures

PROTECTIVE SLEEVE FOR THE SHROUD OF A HOT METAL LADLE

BACKGROUND OF THE INVENTION

1. Technical Field

This invention relates to hot metal ladles and a device for protecting the shroud depending therefrom through which hot metal is delivered to a small vessel, such as a tundish.

2. Description of the Prior Art

No prior art methods or devices are known whereby a relatively simple and inexpensive, expendible sleeve is positioned around the shroud of a ladle to protect the same from erosion while retaining the heat of the molten metal flowing through the shroud.

SUMMARY OF THE INVENTION

A method and apparatus for protecting the shroud of a hot metal ladle used to maintain a neutral atmosphere for molten metal flowing therethrough comprises protecting the exterior of the shroud by an insulating sleeve applied to the exterior of the shroud, the sleeve being formed of a composition including dolomite or magnesite, silica and a bonding material that will neutralize acid slag on the molten metal in the receptacle and thus prevent erosion of the sleeve and the shroud as well as preventing a slag accumulation on the sleeve and the shroud. An expanding insulating compound, preferably including burnt lime, aluminum and aluminum dross, fluorspar and acid treated graphite or the like is positioned on the molten metal in the receptacle prevents atmospheric air from contacting the molten metal.

DESCRIPTION OF THE PREFERRED EMBODIMENT

Figure 1:
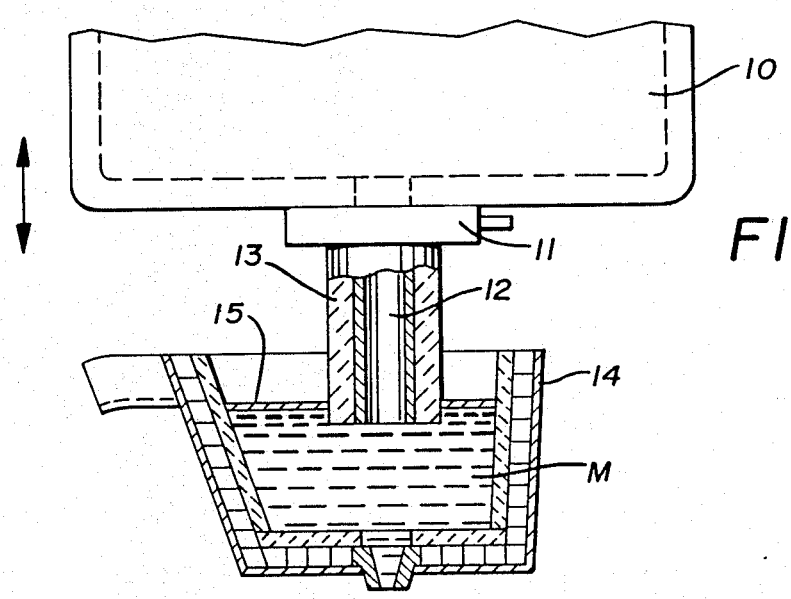
FIG. 1 is a side elevation with parts broken away of a portion of a hot metal ladle and a shroud and protecting sleeve depending therefrom into a receptacle.

By referring to FIG. 1 of the drawings, the lower portion of a hot metal ladle 10 is illustrated with the usual slide valve 11 controlling the discharge opening thereof. The customary shroud 12 depends from the slide valve 11 and is illustrated with a protective sleeve 13 thereabout. The shroud 12 and sleeve 13 are shown partially immersed in molten metal M in a receptacle 14 which is a small vessel, such as a tundish, which acts as a constant head tank usually positioned between a continuous casting mold and the ladle in which the molten metal is stored. As metal is poured from the tundish into the mold, the level is made up by the additions of molten metal from the ladle. It is also possible using a tundish to cast more than one ladleful of metal continuously since the tundish acts as a molten metal reservoir.

The molten metal M usually has a layer of molten slag 15 floating thereon. The depending shroud 12 structurally prevents the entrance of atmospheric air into the molten metal flowing into the tundish. The layer of molten slag 15 provides some protection with respect to atmospheric air contacting the molten metal in the tundish and by referring to FIG. 5 of the drawings, a sealing ladle covering compound 16 will be seen on the molten slag 15 which prevents atmospheric air from contacting either the molten slag or the molten metal thereinunder. The compound may be that disclosed in my U.S. Pat. No. 4,462,834 or a modification of the compound shown in my U.S. Pat. No. 4,586,956.

Figure 2:
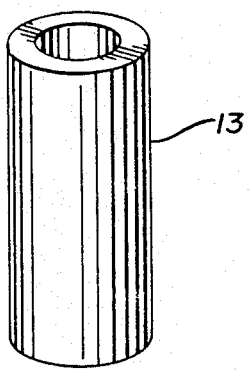
FIG. 2 is a perspective view of a unitary protective sleeve.
Figure 3:
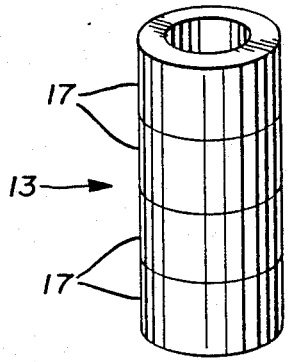
FIG. 3 is a perspective view of a multiple part protective sleeve.
Figure 4:
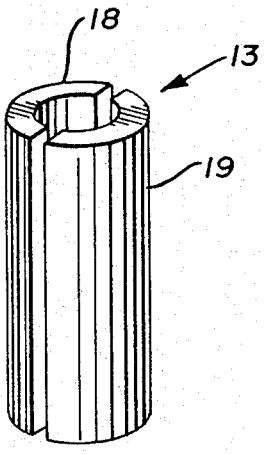
FIG. 4 is a perspective view of a two-part protective sleeve.

By referring now to FIGS. 1 and 2 of the drawings, it will be seen that the protective sleeve 13 is illustrated as a single elongated cylindrical shape and that in FIG. 3 it is illustrated as a plurality of superimposed short cylindrical members 17, while in FIG. 4 it is disclosed as a pair of vertically standing half cylindrical sections 18 and 19. The assembly of the relatively short cylindrical sections 17 in FIG. 3 and the two half cylindrical sections 18 and 19 of FIG. 4 when assembled form the protective sleeve 13 referred to in connection with FIGS. 1 and 5 of the drawings.

The protective sleeve 13 in its several configurations may be formed of clay including dolomite or magnesite, silica, sand, granulated slag and ground fired clay together with a suitable bonding material which may be any one of the following: resin urea formaldehyde, sodium silicate and phenolic resin. The preferable compound includes dolomite, magnesite, silica or the like which will resist erosion that occurs from the contact of the molten slag and the molten metal, such as steel. Eliminating the erosion directly reduces the insoluble nonmetallics that otherwise accumulate in the molten metal in the tundish and flow into the mold.

The preferred compound used in forming the protective sleeve additionally stops aluminum oxide from accumulating around the shroud and thus further contributes to the control of insoluble non-metallics entering the molten metal such as steel in the tundish and mold.

It will be seen that the combination of the ladle covering compound and the compound from which the protective sleeve is formed will neutralize the usual acid slag chemistry so that a neutral slag remains which contributes greatly to the production of clean molten metal, such as steel, which is highly desirable when supplying a continuous casting mold. The ability of the preferred compound of the protective sleeve to stop the accumulation of aluminum oxide on the shroud or sleeve greatly facilites the ability of the ladle covering compound 16 to gather and hold any and all insoluble non-metallics that are in the molten steel in the tundish.

Figure 5:
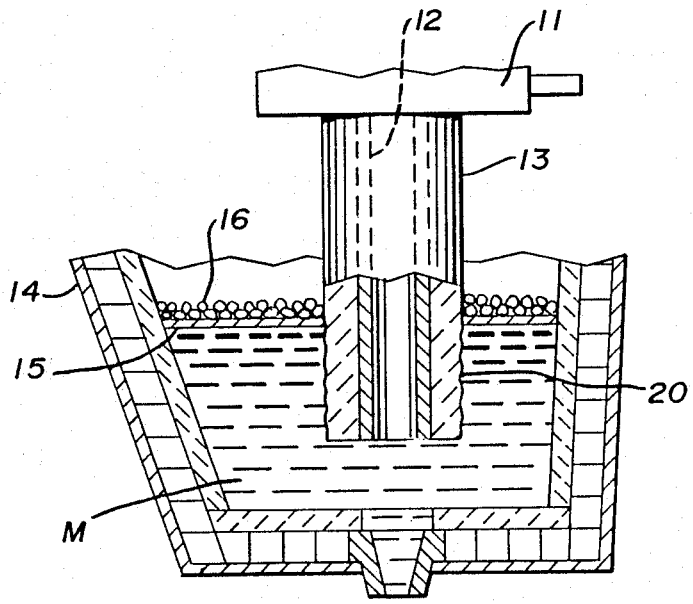
FIG. 5 is a vertical section through a receptacle and the shroud and protective sleeve of the invention immersed in molten metal therein.

By referring to FIG. 5 of the drawings, it will be seen that the exterior of the protective sleeve 13 that is immersed in the molten metal M is shown slightly roughened at 20 as occurs when small amounts of the preferable compound from which the protective sleeve 13 is formed have reacted with the acid slag and neutralized the same.

It will further be seen that when the protective sleeve 13 is attached to the shroud 12 and the same partially immersed in the molten metal M in the receptacle 14 as seen in FIG. 5 and the ladle covering compound 16 positioned over the slag layer 15, heat loss of the metal in the receptacle 14 is held at the very minimum and sculling that normally occurs at the slag line contact is eliminated or greatly reduced.

Those skilled in the art will observe that by utilizing the protective sleeve 13 on the depending shroud 12 of a ladle supplying molten metal such as steel to a receptacle such as the tundish disclosed herein which in turn is supplying molten metal to a continuous casting mold and the desirable ladle covering compound 16 is applied to the surface of the neutralized slag, the combined actions of the protective sleeve and the ladle covering compound result in ultra-clean steel being supplied the continuous casting mold and those skilled in the art will observe that the substantially extended life of the shroud when covered by the protective sleeve of the invention permits additional castings to be made into the tundish without the normal problems of changing or stop pouring of the heat due to excessive shroud erosion as has heretofore been the case.

It has been determined that the wall thickness of the protective sleeve 13, whether it is a single elongated cylindrical shape such as illustrated in FIGS. 1 and 2 or the vertically assembled multiple short cylindrical shape 17 or the half circular vertical portions 18 and 19 of FIG. 4, should be at least double the wall thickness of the depending shroud 12 of the ladle 10 in order to provide for the combination of desirable effects hereinbefore described.

The inner diameter of the protective sleeve 13 is substantially the same as the outer diameter of the shroud so that the resulting tight fit holds the sleeve on the shroud and prevents molten metal and/or slag from contacting the shroud. A ceramic cement may be used if desired to insure the seal attachment of the sleeve.

Having thus described my invention, what I claim is:

1. In an apparatus for cleaning and delivering molten steel from a ladle to a mold comprising a generally vertically extending continuous fluid flow path defined by an interconnecting tubular shroud and a receptacle, the shroud communicating with said ladle and the receptacle, and the receptacle communicating with said mold; the improvement comprising the combination of protective insulating clay sleeve means positioned on said shroud and extending with said shroud into said receptacle so as to be at least partially immersed in said molten steel in said receptacle, said clay sleeve means incorporating a reactive agent from a group including dolomite, magnesite, and silica for neutralizing acid slag on said molten metal in said receptacle and a horizontally disposed closure means comprising an expanding insulating covering compound on said slag for absorbing non-metallic inclusions in said molten steel and slag.

2. The improvement in an apparatus for cleaning and delivering molten steel from a ladle to a mold set forth in claim 1 and wherein said protective sleeve means is formed of a compound including high temperature refractory fibers, dolomite and silica characterized by resisting erosion by the slag and molten metal and preventing accumulation of aluminum oxide thereon.

3. A method of delivering and cleaning molten steel from a ladle to a mold which includes the steps of flowing the molten steel through a shroud communicating with said ladle into a receptacle communicating with said mold, insulating said shroud with a protective sleeve thereon, immersing a portion of said shroud and sleeve in said molten steel with slag thereon in said receptacle to protect said molten steel in said receptacle around said shroud and sleeve from atmospheric air, neutralizing acid in said slag with a reactive agent in said sleeve, protecting said molten steel in said receptacle with a sealing covering compound, and substantially maintaining the temperature of said molten steel in said shroud with said protective sleeve.

4. The improvement in an apparatus for cleaning and delivering molten steel from a ladle to a mold set forth in claim 1 and wherein said clay sleeve means incorporates a bonding material from a group including resin urea formaldehyde, sodium silicate, and phenolic resin.

* * * * *